US008059493B2

(12) United States Patent
Li

(10) Patent No.: US 8,059,493 B2
(45) Date of Patent: Nov. 15, 2011

(54) ALARM SYSTEM AND METHOD FOR ELECTRONIC DEVICE

(75) Inventor: Jun Li, Shenzhen (CN)

(73) Assignees: Shenzhen Futaihong Precision Industry Co., Ltd., ShenZhen, Guangdong Province (CN); Chi Mei Communication Systems, Inc., Tu-Cheng, New Taipei (TW)

( * ) Notice: Subject to any disclaimer, the term of this patent is extended or adjusted under 35 U.S.C. 154(b) by 0 days.

(21) Appl. No.: 12/793,627

(22) Filed: Jun. 3, 2010

(65) Prior Publication Data

US 2011/0044136 A1 Feb. 24, 2011

(51) Int. Cl.
*G04B 23/02* (2006.01)

(52) U.S. Cl. ..... 368/244; 368/109; 368/13

(58) Field of Classification Search ..... 368/13, 368/89, 109, 244
See application file for complete search history.

(56) References Cited

U.S. PATENT DOCUMENTS

| | | | | |
|---|---|---|---|---|
| 4,444,511 | A * | 4/1984 | Ogihara et al. | 368/69 |
| 5,089,998 | A * | 2/1992 | Rund | 368/72 |
| 5,177,716 | A * | 1/1993 | Kuo | 368/262 |
| 2003/0032457 | A1 * | 2/2003 | Leung | 455/567 |
| 2003/0174586 | A1 * | 9/2003 | Hon et al. | 368/84 |
| 2007/0008163 | A1 * | 1/2007 | Drake | 340/686.1 |
| 2008/0174412 | A1 * | 7/2008 | Sward et al. | 340/309.7 |
| 2010/0079281 | A1 * | 4/2010 | Drake | 340/540 |

* cited by examiner

*Primary Examiner* — Sean Kayes
(74) *Attorney, Agent, or Firm* — Altis Law Group, Inc.

(57) ABSTRACT

An alarm system and method for an electronic device that includes an alarm unit and a setting unit. The alarm system provides alarm management for the electronic device to prevent users from oversleeping. The setting unit is operable to set an alarm mode and an alarm time of the electronic device. The alarm mode includes a normal mode and a non-normal mode. If the electronic device is in the non-normal mode, the alarm unit is activated to ring for a default period at the alarm time and a stop option is disabled, where the stop option is operable to stop the alarm unit from ringing.

12 Claims, 4 Drawing Sheets

ALARM SYSTEM AND METHOD FOR ELECTRONIC DEVICE

BACKGROUND

1. Technical Field

The present disclosure relates to an alarm system and method for an electronic device.

2. Description of Related Art

Alarm functions are widely used in electronic devices to alert a user of an impending event. When an alarm of an electronic device rings, a display of the electronic device often provides the option to turn the alarm off. However, turning the alarm off using the display may be too easy and can result in the user oversleeping.

Accordingly, an improved alarm system and system are called for in order to overcome the limitations described.

DETAILED DESCRIPTION

In general, the word "unit" as used herein, refers to logic embodied in hardware or firmware, or to a collection of software instructions, written in a programming language, such as, for example, Java, C, or assembly. One or more software instructions in the unit may be integrated in firmware, such as an EPROM. It will be appreciated that module may comprise connected logic units, such as gates and flip-flops, and may comprise programmable units, such as programmable gate arrays or processors. The unit described herein may be implemented as either software and/or hardware unit and may be stored in any type of computer-readable medium or other computer storage device.

Figure 1:
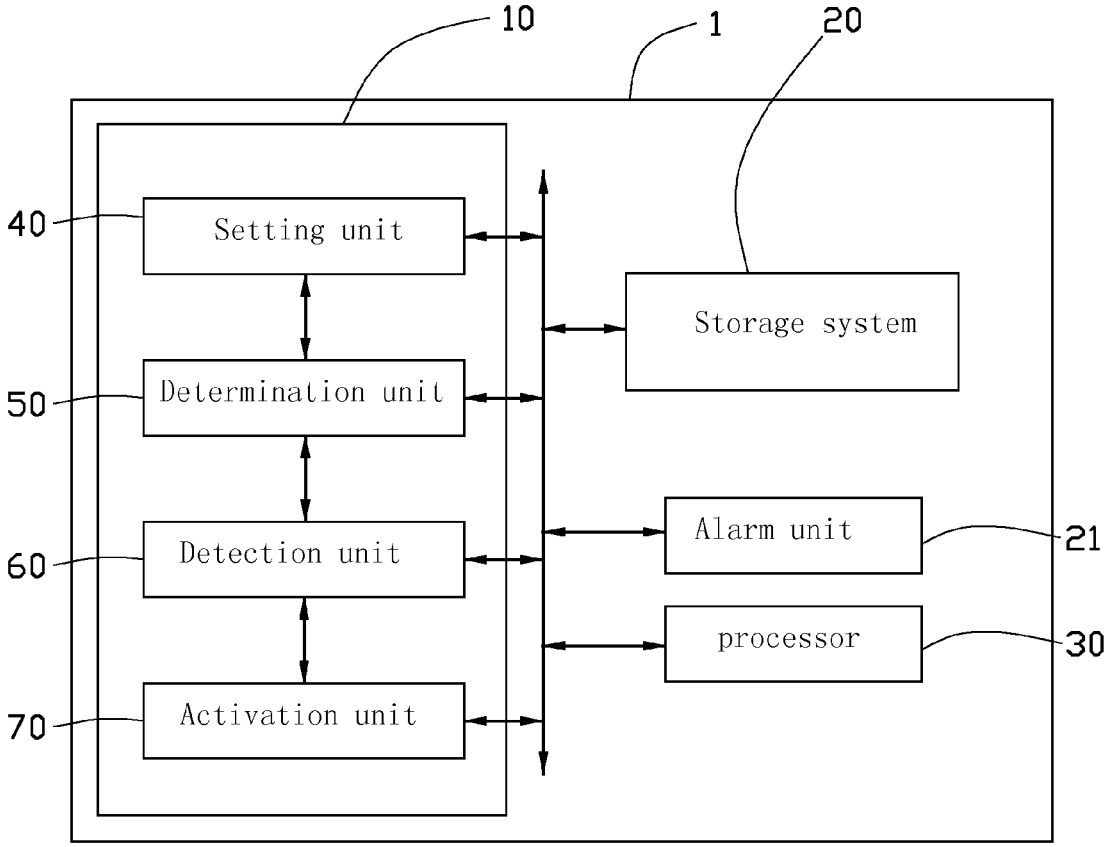
FIG. 1 is a block diagram of one embodiment of an electronic device.

FIG. 1 is a block diagram of one embodiment of an electronic device 1 comprising an alarm system 10. The alarm system 10 provides alarm management for the electronic device 1 to prevent users from oversleeping. The electronic device 1 includes a storage system 20, an alarm unit 21, a processor 30, a setting unit 40, a determination unit 50, a detection unit 60, and an activation unit 70. The processor 30 may execute one or more programs stored in the storage system 20 to provide functions for the alarm unit 21, the setting unit 40, the determination unit 50, the detection unit 60, and the activation unit 70.

The electronic device 1 is generally controlled and coordinated by an operating system, such as UNIX, Linux, Windows, Mac OS, an embedded operating system, or any other compatible system. Alternatively, the alarm system 10 may be controlled by a proprietary operating system. Typical operating systems control and schedule computer processes for execution, perform memory management, provide file system, networking, and I/O services, and provide a user interface, such as a graphical user interface (GUI), among other tasks.

The setting unit 40 is operable to set an alarm mode and an alarm time of the electronic device 1, where the alarm mode includes a normal mode and a non-normal mode. The alarm mode is a setting that is used to define ring types for an alarm of the alarm unit 21. The determination unit 50 is operable to determine whether the electronic device in the non-normal mode. It should be understood that the normal mode provides the alarm at the alarm time, and the alarm can be interrupted by users. Similarly, the non-normal mode provides the alarm at the alarm time, and the alarm can not be interrupted by the users.

The detection unit 60 is operable to detect an interrupt event of the electronic device 1. The interrupt event may include an incoming call, a short message service (SMS), or a multimedia messaging service (MMS), for example.

The activation unit 70 is operable to activate the alarm unit 21 to ring for a default period at the alarm time and disable a stop option if the alarm unit 21 is in the non-normal mode, where the stop option is operable to stop the alarm unit 21 from ringing. Alternatively, if the alarm unit 21 is in the normal mode, the activation unit 70 enables the stop option and a snooze option to delay the ringing of the alarm unit 21 for a predetermined time period. The activation unit 70 further enables an interrupt option to temporarily stop the alarm unit 21 from ringing when the interrupt event occurs.

Figure 2A:
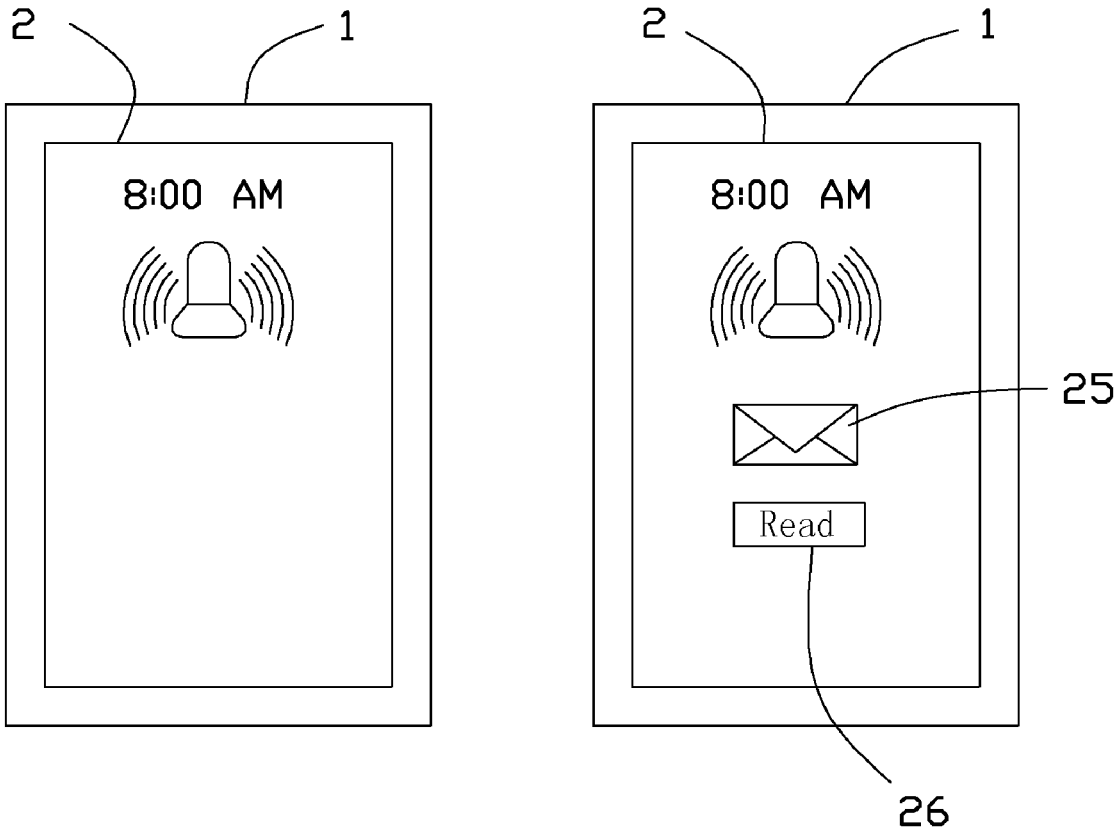
FIGS. 2A-2B show exemplary embodiments of the electronic device of FIG. 1.
Figure 2B:
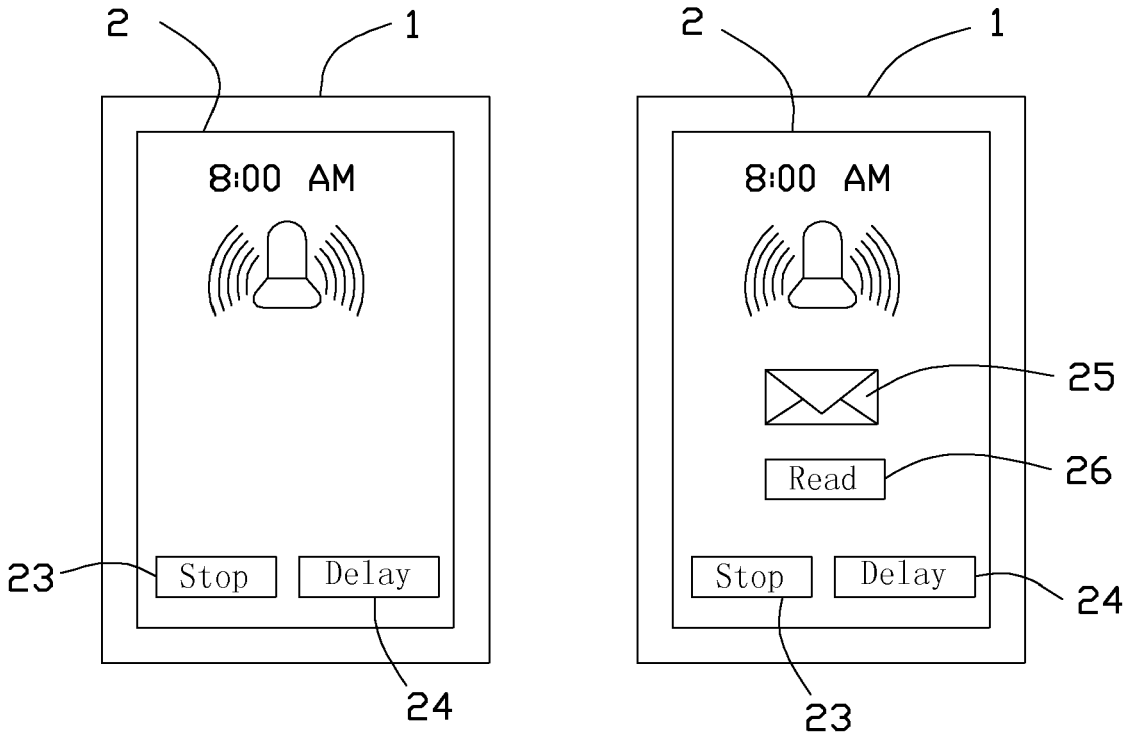

FIGS. 2A-2B show exemplary embodiments of the electronic device 1 of FIG. 1. The electronic device 1 further includes a touch screen 2. As shown in FIG. 2A, the electronic device 1 is in the non-normal mode. The alarm unit 21 rings at the alarm time, 8:00 AM, and there is no option displayed on the touch screen 2 to stop or delay the alarm unit 21. When the electronic device 1 receives a short message 25, the touch screen 2 will display a virtual key "read" 26. The user may contact the virtual key "read" 26 by his/her finger to read the short message 25.

As shown in FIG. 2B, the electronic device 1 is in the normal mode. The alarm unit 21 rings at the alarm time, 8:00 AM, and a virtual key "stop" 23 and a virtual key "delay" 24 are displayed on the touch screen 2 to stop and delay the alarm respectively. When the electronic device 1 receives the short message 25, the touch screen 2 also displays the virtual key "read" 26.

Figure 3:
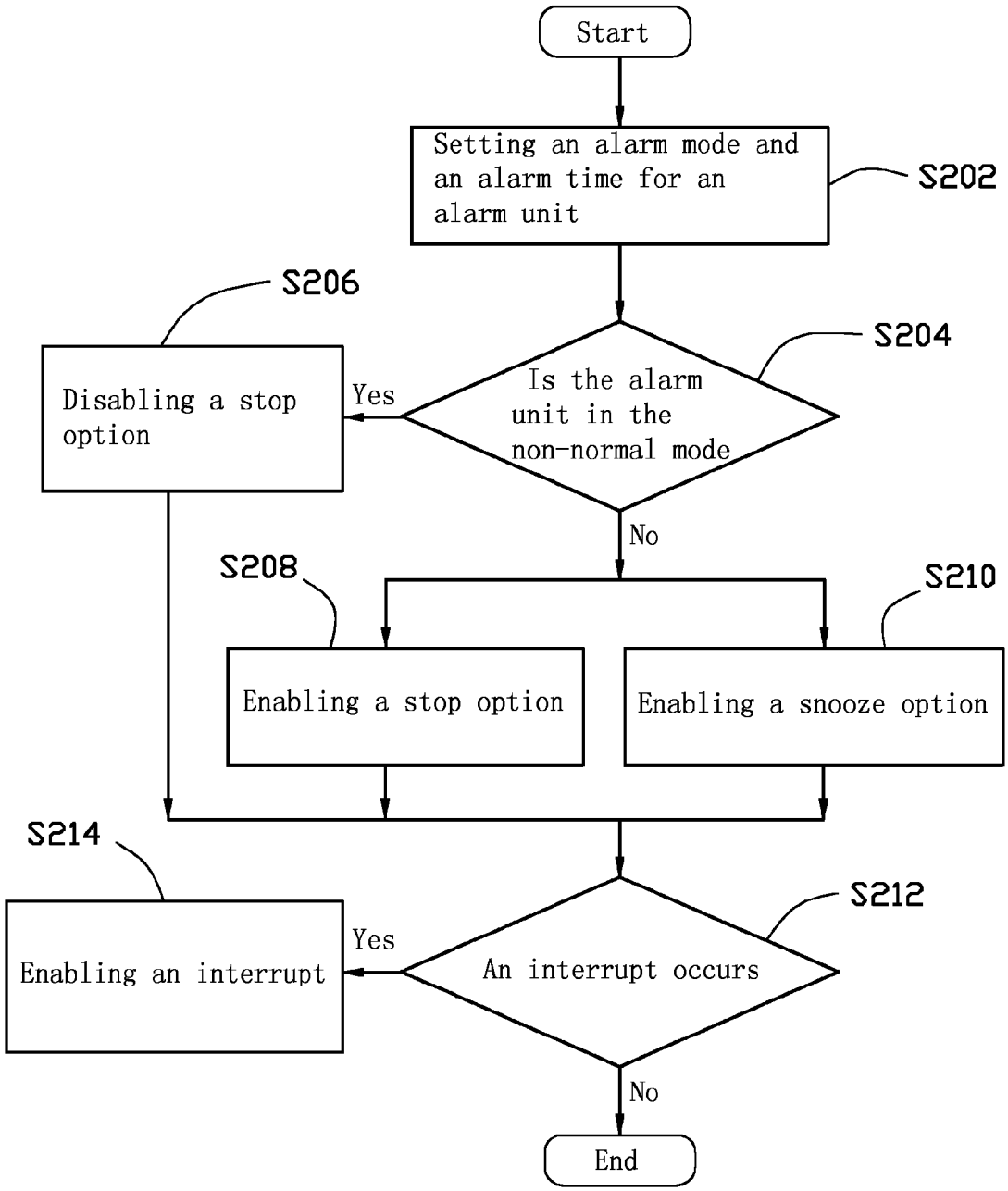
FIG. 3 is a flowchart illustrating one embodiment of an alarm method for an electronic device.

FIG. 3 is a flowchart illustrating one embodiment of an alarm method for the electronic device 1. Depending on the embodiment, additional blocks in the flow of FIG. 3 may be added, others removed, and the ordering of the blocks may be changed.

In block S202, the setting unit 40 sets the alarm mode and the alarm time of electronic device 1. The alarm mode includes the normal mode and the non-normal mode.

In block S204, the determination unit 50 determines whether the electronic device 1 is in the non-normal mode. If the electronic device 1 is in the non-normal mode, in block S206, the activation unit 70 disables the stop option, and the process goes to block S212.

If the electronic device 1 is in the normal mode, in block S208, the activation unit 70 enables the stop option when the alarm unit 21 rings at the alarm time, and the process goes to block S212. In addition, in block S210, the activation unit 70 enables the snooze option when the alarm unit 21 rings at the alarm time, and the process goes to block S212.

In block S212, the detection unit 60 detects the interrupt event of electronic device 1. If the interrupt event is detected, in block S214, the activation unit 70 enables the interrupt option when the alarm unit 21 rings at the alarm time. If the interrupt event is not detected in block S212, the process is complete.

The present disclosure provides an alarm system and method for an electronic device. An efficient alarm is thus provided to prevent oversleeping of users.

Although certain inventive embodiments of the present disclosure have been specifically described, the present disclosure is not to be construed as being limited thereto. Various changes or modifications may be made to the present disclosure without departing from the scope and spirit of the present disclosure.

What is claimed is:

1. A computer-implemented alarm method for an electronic device, the electronic device comprising an alarm unit, the method comprising:

setting an alarm mode and an alarm time of the electronic device, the alarm mode comprising a normal mode and a non-normal mode;

determining whether the electronic device is in the non-normal mode;

detecting an interrupt event of the electronic device;

activating the alarm unit to ring for a default period at the alarm time; and disabling a stop option of the electronic device if the electronic device is in the non-normal mode, and enabling a snooze option of the electronic device to delay the alarm unit for a predetermined time period if the electronic device is in the normal mode, wherein the stop option is operable to stop the alarm unit from ringing.

2. The method of claim 1, further comprising:

enabling the stop option if the electronic device is in the normal mode.

3. The method of claim 1, further comprising:

enabling an interrupt option to temporarily stop the alarm unit from ringing when the interrupt event occurs.

4. The method of claim 3, wherein the interrupt event comprises an incoming call, a short message service (SMS), and a multimedia messaging service (MMS).

5. An electronic device, comprising:

a storage system;

at least one processor;

one or more programs stored in the storage system and being executable by the at least one processor;

an alarm unit operable to ring;

a setting unit operable to set an alarm mode and an alarm time of the electronic device, the alarm mode comprising a normal mode and a non-normal mode;

a determination unit operable to determine the alarm mode of the electronic device;

a detection unit operable to detect an interrupt event of the electronic device; and an activation unit operable to activate the alarm unit to ring for a default period at the alarm time and disable a stop option if the alarm unit is in the non-normal mode, and operable to enable a snooze option to delay the alarm unit for a predetermined time period if the electronic device is in the normal mode, wherein the stop option is operable to stop the alarm from ringing.

6. The electronic device of claim 5, wherein the activation unit is further operable to enable the stop option if the electronic device is in the normal mode.

7. The electronic device of claim 5, wherein the activation unit is further operable to enable an interrupt option to temporarily stop the alarm unit from ringing when the interrupt event occurs.

8. The electronic device of claim 7, wherein the interrupt event comprises an incoming call, a short message service (SMS), and a multimedia messaging service (MMS).

9. A storage medium having stored thereon instructions that, when executed by a processor, causing the processor to perform an alarm method for an electronic device, the electronic device comprising an alarm unit, wherein the method comprises:

set an alarm mode and an alarm time of the electronic device, the alarm mode comprising a normal mode and a non-normal mode;

determine whether the electronic device is in the non-normal mode;

detect an interrupt event of the electronic device;

activate the alarm unit to ring for a default period at the alarm time; and disable a stop option if the alarm unit is in the non-normal mode, and enable a snooze option to delay the alarm unit for a predetermined time period if the electronic device is in the normal mode, wherein the stop option is operable to stop the alarm unit from ringing.

10. The storage medium of claim 9, wherein the method further comprises:

enable the stop option if the electronic device is in the normal mode.

11. The storage medium of claim 9, wherein the method further comprises:

enable an interrupt option to temporarily stop the alarm unit from ringing when the interrupt event occurs.

12. The storage medium of claim 11, wherein the interrupt event comprises an incoming call, a short message service (SMS), and a multimedia messaging service (MMS).

* * * * *